US012049897B2

(12) United States Patent
Li et al.

(10) Patent No.: US 12,049,897 B2
(45) Date of Patent: Jul. 30, 2024

(54) BAFFLE PLATE FOR COMPRESSOR, COMPRESSOR, AND REFRIGERATION APPARATUS

(71) Applicant: GUANGDONG MEIZHI COMPRESSOR CO., LTD., Guangdong (CN)

(72) Inventors: Yang Li, Guangdong (CN); Hongjun Cao, Guangdong (CN); Song Zhu, Guangdong (CN)

(73) Assignee: GUANGDONG MEIZHI COMPRESSOR CO., LTD., Guangdong (CN)

( * ) Notice: Subject to any disclaimer, the term of this patent is extended or adjusted under 35 U.S.C. 154(b) by 94 days.

(21) Appl. No.: 17/556,355

(22) Filed: Dec. 20, 2021

(65) Prior Publication Data

US 2022/0112898 A1 Apr. 14, 2022

Related U.S. Application Data

(63) Continuation of application No. PCT/CN2019/120826, filed on Nov. 26, 2019.

(30) Foreign Application Priority Data

Sep. 24, 2019 (CN) ..... 201910923601.2

(51) Int. Cl.
*F04C 29/06* (2006.01)
*F04C 18/356* (2006.01)
(Continued)

(52) U.S. Cl.
CPC ..... *F04C 29/068* (2013.01); *F04C 23/02* (2013.01); *F04C 29/028* (2013.01);
(Continued)

(58) Field of Classification Search
CPC ..... F04C 29/02; F04C 29/026; F04C 29/028; F04C 29/06; F04C 29/065; F04C 29/068;
(Continued)

(56) References Cited

U.S. PATENT DOCUMENTS 6,631,617 B1 10/2003 Dreiman et al.
2008/0078618 A1* 4/2008 Lee ..... F04C 29/028 62/84
2019/0271314 A1* 9/2019 Hill ..... F04C 23/02

FOREIGN PATENT DOCUMENTS

CN 101684814 A 3/2010
CN 201953660 U * 8/2011
(Continued)

OTHER PUBLICATIONS

International Search Report dated Jun. 2, 2020 issued in PCT/CN2019/120826.
(Continued)

*Primary Examiner* — Mark A Laurenzi
*Assistant Examiner* — Xiaoting Hu
(74) *Attorney, Agent, or Firm* — Scully, Scott, Murphy & Presser, P.C.

(57) ABSTRACT

A baffle plate for a compressor, a compressor, and refrigeration apparatus are provided. The baffle plate has a plate body, a through hole and a connection part. The through hole is formed in the plate body. The plate body extends from the through hole in a direction deviating from the axis of the through hole. The connection part is connected with the plate body and is used for connecting the plate body to a non-rotating member. A fixed baffle plate is arranged in the compressor, to physically block the gas flow and form a space for stabilizing the refrigerant oil or lubricant oil on one side of the baffle plate corresponding to the oil sump. The space can isolate the disturbance from spiral flow of a lower
(Continued)

cavity to the oil sump caused by the rotation of the motor when the compressor operates.

11 Claims, 7 Drawing Sheets

(51) Int. Cl.
*F04C 23/02* (2006.01)
*F04C 29/02* (2006.01)

(52) U.S. Cl.
CPC ..... *F04C 18/356* (2013.01); *F04C 2240/30* (2013.01); *F04C 2240/50* (2013.01); *F04C 2240/60* (2013.01); *F04C 2240/80* (2013.01); *F04C 2240/805* (2013.01)

(58) Field of Classification Search
CPC ..... F04C 18/32–46; F04C 23/02; F04C 2240/30; F04C 2240/50; F04C 2240/60; F04C 2240/80; F04C 2240/805; F04C 29/066
See application file for complete search history.

(56) References Cited

FOREIGN PATENT DOCUMENTS

| | | | | | |
|---|---|---|---|---|---|
| CN | 201953660 | U | | 8/2011 | |
| CN | 203161550 | U | | 8/2013 | |
| CN | 203348086 | U | | 12/2013 | |
| CN | 103541904 | A | | 1/2014 | |
| CN | 204244003 | U | | 4/2015 | |
| CN | 205349749 | U | | 6/2016 | |
| CN | 105782053 | A | | 7/2016 | |
| CN | 105822559 | A | | 8/2016 | |
| CN | 106015007 | A | | 10/2016 | |
| CN | 106246547 | A | | 12/2016 | |
| CN | 206917862 | U | | 1/2018 | |
| CN | 207349095 | U | | 5/2018 | |
| CN | 208534755 | U | | 2/2019 | |
| EP | 3447296 | A1 | * | 2/2019 | ..... F04B 39/00 |
| JP | 58178490 | U | * | 11/1983 | |
| JP | S58-178490 | U | | 11/1983 | |
| JP | S6133988 | U | | 3/1986 | |
| JP | S6162297 | U | | 4/1986 | |
| JP | S61-87984 | A | | 5/1986 | |
| JP | H02215990 | A | | 8/1990 | |
| JP | H03997 | A | | 1/1991 | |
| JP | H06285390 | A | * | 10/1994 | |
| JP | 2002202081 | A | | 7/2002 | |
| JP | 2006283607 | A | | 10/2006 | |
| JP | 2009167829 | A | | 7/2009 | |
| WO | 2008042667 | A2 | | 4/2008 | |
| WO | WO-2017216875 | A1 | * | 12/2017 | ..... F04C 18/02 |

OTHER PUBLICATIONS

First Chinese Office Action dated Jul. 29, 2021 issued in CN 201910923601.2.
Second Chinese Office Action dated Oct. 11, 2021 issued in 201910923601.2.
First Search dated Jul. 1, 2021 issued in CN 201910923601.2.
Supplementary Search dated Sep. 29, 2021 issued in CN 201910923601.2.
Supplementary European Search Report dated Jul. 19, 2022 received in European Patent Application No. EP 19946537.8.
First OA dated Jul. 21, 2023 received in Korea Patent Office Application No. 10-2021-7038403.
First OA dated Nov. 10, 2022 received in Japan Patent Office Application No. 2021-569961.
First OA dated Mar. 22, 2023 received in CNIPA Application No. 202210148297.0.
First OA dated Jun. 21, 2023 received in CNIPA Application No. 202210148297.0.
Decision of Rejection dated Sep. 28, 2023 received in Chinese Patent Application No. CN 202210148297.0.
Office Action dated Oct. 25, 2023 received in Indian Patent Application No. IN 202147053959.

* cited by examiner

BAFFLE PLATE FOR COMPRESSOR, COMPRESSOR, AND REFRIGERATION APPARATUS

CROSS-REFERENCE TO RELATED APPLICATIONS

The present application is a continuation application of PCT International Application No. PCT/CN2019/120826, filed on Nov. 26, 2019, which claims priority to and benefits of Chinese Patent Application No. 201910923601.2 filed with China National Intellectual Property Administration on Sep. 24, 2019 and entitled "Baffle Plate For Compressor, Compressor, And Refrigeration Apparatus", the entire contents of which are incorporated herein by reference for all purposes. No new matter has been introduced.

FIELD

The present disclosure relates to the technical field of compressors, and in particular, to a baffle plate for a compressor, a compressor, and a refrigeration apparatus.

BACKGROUND

In a rotary compressor in the related technologies, a refrigerant oil or lubricant oil is stored at the bottom of a closed housing. When the compressor operates, the refrigerant oil or lubricant oil will fluctuate severely under the disturbance of a rotating rotor, so that the refrigerant oil or lubricant oil will move to a relatively high position and move to the upper space of a motor in a rotor through hole, a motor gap and an air gap between a stator and the housing, most of the refrigerant oil or lubricant oil will fall back to the bottom of the compressor, while the rest will be discharged from the compressor through a discharge pipe along with the compressed gas with high temperature and high pressure to enter an external pipeline. For example, for an air conditioner, the rest will enter a system pipeline and form an oil film on the system pipeline to increase the thermal resistance, thereby affecting the heat exchange efficiency and the operation effect of the air conditioner.

SUMMARY

The present disclosure aims to solve at least one of technical problems existing in the prior art or related technologies.

To this end, a first aspect of the present disclosure provides a baffle plate for a compressor.

A second aspect of the present disclosure provides a compressor.

A third aspect of the present disclosure provides a refrigeration apparatus.

In view of this, according to the first aspect of the present disclosure, a baffle plate for a compressor is provided, which comprises: a plate body, a through hole and a connection part. The through hole is formed in the plate body, and the plate body extends from the through hole in a direction deviating from the axis of the through hole. The connection part is connected with the plate body and is used for connecting the plate body to a non-rotating member.

The baffle plate for a compressor provided by embodiments of the present disclosure can be adopted to solve the problems of great fluctuation in an oil sump and high oil output of the compressor in the related technologies. When the compressor is in an operating condition, the rotor rotates to drive a balance weight at a lower part to rotate, so that the gas in the lower part of the compressor is in an unstable severe rotating state. A fixed baffle plate is arranged in the compressor, for example, between a cylinder and the motor of the compressor, the baffle plate is connected with the non-rotating member to prevent the baffle plate from rotating, and a plate body of the baffle plate extends from the through hole to the direction deviating from the axis of the through hole, i.e., the baffle plate extends radially in the whole circumferential direction, thereby physically blocking the gas flow, and forming a space for stabilizing the refrigerant oil or lubricant oil on one side of the baffle plate corresponding to the oil sump. The space can isolate the disturbance from spiral flow of a lower cavity to the oil sump caused by the rotation of the motor when the compressor operates, i.e., isolate the disturbance from high-speed movement of the gas flow to the oil sump, thereby improving the stability of the oil sump, reducing the fluctuation of an oil level at the bottom of the compressor, further reducing the formation of oil droplets caused by the fluctuation, and preventing excessive refrigerant oil or lubricant oil from being brought to the upper part of the motor by the gas flow due to severe fluctuation of the oil level. On the one hand, the baffle plate can be provided to reduce oil droplets entrained by the gas in the compressor, reduce the oil output of the compressor, and reduce the volume of the oil film in the pipeline, and for the refrigeration apparatus, the baffle plate can be provided to reduce the thermal resistance of the pipeline, improve the refrigerating and heating effects, and increase the coefficient of performance (COP) of the compressor. On the other hand, the baffle plate can be provided to reduce the refrigerant oil or lubricant oil excessively accumulated in the upper part of the motor in the compressor, provide a larger buffer space for gas, and contribute to reducing pressure pulsation and noise, and for the refrigeration apparatus, the baffle plate can be provided to reduce the resistance of refrigerant flowing in the compressor, improve the refrigerating capacity and heating capacity of the compressor, and increase the COP of the compressor.

In addition, the baffle plate for a compressor in the above embodiment provided by the present disclosure may also have the additional technical features as follows.

In an embodiment, the connection part comprises one or a combination of a welding part, a riveting part and an adhesion part.

In this embodiment, the connection part is defined to comprise one or a combination of the welding part, the riveting part and the adhesion part, i.e., the baffle plate can be fixedly connected with the non-rotating member in the compressor by welding, riveting and adhering, thereby reliably fixing the baffle plate.

In an embodiment, the plate body is one or a combination of a flat plate, an arc plate, a curved plate and a multi-section plate.

In this embodiment, the plate body of the baffle plate may be one or a combination of the flat plate, the arc plate, the curved plate and the multi-section plate, all of which can physically block the gas flow and enrich the gas flow control manner.

In an embodiment, the plate body extends in a direction parallel to the axis of the through hole.

In this embodiment, the plate body is defined to extend in a direction parallel to the axis of the through hole. Particularly, when the plate body is one or a combination of the arc plate, the curved plate and the multi-section plate, the plate body can extend not only radially but also axially. At this moment, the plate body extends in one direction instead of two directions, such as, in a direction where the oil sump is located, so that the plate body is umbrella-shaped to contribute to improving the effect of reducing the fluctuation of the oil level.

In an embodiment, the baffle plate has a thickness of 0.5 mm to 4 mm.

In this embodiment, the baffle plate is defined to have a thickness of 0.5 mm to 4 mm, which not only ensures that the baffle plate is thick enough to effectively suppress the fluctuation of the oil level and also has enough rigidity to avoid damage from the impact of gas flow, thereby ensuring the reliability of products and prolonging the service life of the products, but also contributes to controlling the weight and material consumption of the baffle plate and avoiding unnecessary weight gain and material waste.

In an embodiment, the baffle plate further comprises a flanging, which is connected with an outer edge of the plate body.

In this embodiment, the baffle plate further comprises the flanging arranged at the outer edge of the plate body, to guide the gas flow and contribute to reducing the gas flow flowing through the outer edge of the plate body in a direction opposite to the flanging, thereby keeping the oil sump stable.

In an embodiment, the baffle plate further comprises a transition part, which is connected between the plate body and the flanging.

In this design, the baffle plate further comprises the transition part connected between the plate body and the flanging, so that the baffle plate can be gradually bent to form the flanging, thereby not only avoiding forming a stress concentration point at a bending position during direct bending and contributing to improving the strength of the baffle plate, but also reducing flow resistance of the gas flow and improving the gas flow guiding effect.

In an embodiment, the transition part is an arc transition part, which has a radius of curvature of 1 mm to 6 mm.

In this embodiment, the transition part is defined as the arc transition part with the radius of curvature of 1 mm to 6 mm, which ensures smooth transition and facilitates processing.

In an embodiment, the arc transition part has a central angle of 35° to 145°.

In this embodiment, the arc transition part is defined to have the corresponding central angle of 35° and 145°, so that the plate body and the flanging are subjected to smooth transition, and the extension direction of the flanging can be reasonably controlled by controlling the central angle to achieve different gas flow guiding effects.

In an embodiment, the baffle plate further comprises at least one exhaust through hole, which are formed in the plate body and used for exhausting gas.

In this embodiment, the baffle plate further comprises the exhaust through hole formed in the plate body and used for exhausting the compressed gas, especially when the baffle plate is arranged above a silencer of the compressor. At this moment, the position of the exhaust through hole may correspond to that of an exhaust port of the silencer, i.e., a projection of the exhaust through hole on an axial projection plane of the compressor corresponds to that of the exhaust port of the silencer on the axial projection plane, thereby ensuring smooth exhaust of the silencer.

In an embodiment, the baffle plate further comprises at least one assembly yielding hole, which are formed in the plate body.

In this embodiment, the baffle plate further comprises the assembly yielding hole formed in the plate body. The number, dimensions and positions of the assembly yielding holes can be set according to the structure assembling requirements of the compressor, to provide an enough assembly operation space when a certain structure needs to be arranged near the baffle plate, comprising but not limited to a welding operation space, a screw mounting space, a riveting operation space and an adhering operation space, thereby contributing to ensuring the smooth assembly of various structures of the compressor.

According to the second aspect of the present disclosure, a compressor is provided, which comprises the baffle plate for a compressor according to any one of the above embodiments, thereby having all the beneficial technical effects of the baffle plate, which will not be repeated here.

In addition, the compressor according to the above embodiments provided by the present disclosure may also have the additional technical features as follows.

In an embodiment, the compressor also comprises a cylinder, a rotating shaft, a motor and a housing. The rotating shaft penetrates the cylinder, the motor is connected with a part of a shaft section of the rotating shaft extending out of the cylinder, and drives the rotating shaft to rotate, and the cylinder, the rotating shaft, the motor and the baffle plate are all located in the housing. The baffle plate is located between the cylinder and the motor, and the rotating shaft penetrates the through hole of the baffle plate.

In this embodiment, the compressor further comprises the housing for providing an accommodating cavity, as well as the cylinder, the rotating shaft and the motor located in the housing, to realize a function of compressing gas. When the compressor is in an operating condition, the rotor rotates to drive a balance weight at a lower part to rotate, so that the gas at the lower part of the compressor is in an unstable severe rotating state. The baffle plate is arranged between the cylinder and the motor, and the rotating shaft is allowed to penetrate the through hole of the baffle plate, so that a space for stabilizing the refrigerant oil or lubricant oil can be formed at one side of the baffle plate deviating from the motor, which effectively isolates the disturbance from the spiral flow of the lower cavity to the oil sump caused by the rotation of the motor, thereby reducing the fluctuation of the oil level at the bottom of the compressor.

In an embodiment, a plane perpendicular to the axis of the rotating shaft is taken as a reference plane, and the projection of the rotor of the motor on the reference plane is located within an outer contour of the projection of the baffle plate on the reference plane.

In this embodiment, the radial extension extent of the baffle plate is defined by the reference plane and the rotor of the motor. The projection of the rotor on the reference plane lie within the outer contour of the projection of the baffle plate on the reference plane, which can ensure that the baffle plate completely covers the rotor in the reference plane, contribute to ensuring the isolation effect of the disturbance caused by the rotation of the rotor and reduce the fluctuation of the oil level of the bottom refrigerant oil.

In an embodiment, a distance between the outer edge of the baffle plate and the housing is less than or equal to 20% of an inner diameter of the housing.

In this embodiment, the radial extension extent of the baffle plate is defined by an angle of the distance between the outer edge of the baffle plate and the housing. If the distance is always less than or equal to 20% of the inner diameter of the housing, the flow resistance at a gap between the outer edge of the baffle plate and the housing is relatively large, and the gas flow is relatively small, thereby keeping the oil sump at the lower part stable.

In an embodiment, the compressor also comprises a main bearing and a silencer. The main bearing is sleeved on the rotating shaft, and the main bearing is located at one side of the cylinder facing the motor. The silencer is arranged on one side of the main bearing deviating from the cylinder, and the rotating shaft penetrates the silencer. The non-rotating member is one or a combination of the housing, the main bearing and the silencer.

In this embodiment, the compressor further comprises the main bearing located on the side of the cylinder facing the motor. The main bearing is used for supporting the rotating shaft and ensure the reliable rotation of the rotating shaft. The compressor also comprises the silencer arranged on the main bearing. The silencer can block the airflow noise when the cylinder exhausts. The non-rotating member connected with the baffle plate may be one or a combination of the housing, the main bearing and the silencer, i.e., the baffle plate may be fixedly connected with any one, any two or all three of the housing, the main bearing and the silencer, thereby reliably locating and fixing the baffle plate.

In an embodiment, the exhaust through hole of the baffle plate is formed in one side of the exhaust port of the silencer facing the motor, and faces the exhaust port.

In this embodiment, the positional relationship between the exhaust through hole of the baffle plate and the exhaust port of the silencer is defined. When the exhaust through hole is formed in the side of the exhaust port of the silencer facing the motor, the exhaust through hole is allowed to face the exhaust port, i.e., the projection of the exhaust through hole on the axial projection plane of the compressor corresponds to that of the exhaust port of the silencer on the axial projection plane, thereby ensuring smooth exhaust of the silencer.

In an embodiment, the silencer is provided with an assembly part, and is connected with the main bearing through the assembly part. The assembly yielding holes of the baffle plate face the assembly part.

In this embodiment, the silencer is also provided with the assembly part to realize the connection with the main bearing. The assembly yielding holes of the baffle plate face the assembly part, and the number, dimensions and positions of the assembly yielding holes correspond to those of the assembly part, thereby ensuring the smooth assembly of the silencer.

In an embodiment, the baffle plate is located between the silencer and the motor, and an aperture of the through hole of the baffle plate is greater than or equal to the aperture of the central hole of the silencer.

In this embodiment, the baffle plate is defined to be arranged between the silencer and the motor. At this moment, if the aperture of the through hole is greater than or equal to the aperture of the central hole of the silencer, the silencer can exhaust smoothly when the silencer exhausts through the central hole, thereby ensuring the reliable operation of the compressor.

According to a third aspect of the present disclosure, the refrigeration apparatus is provided, which comprises the baffle plate for a compressor according to any one of the above embodiments, or the compressor according to any one of the above embodiments, thereby having all the beneficial technical effects of the baffle plate or the compressor, which will not be repeated here.

Additional aspects and advantages of the present disclosure will be apparent from the following description, or may be learned by practice of the present disclosure.

BRIEF DESCRIPTION OF THE DRAWINGS

The above and/or additional aspects and advantages of the present disclosure will become obvious and easy to understand from the description of the embodiments in conjunction with the following drawings, wherein.

Figure 1:
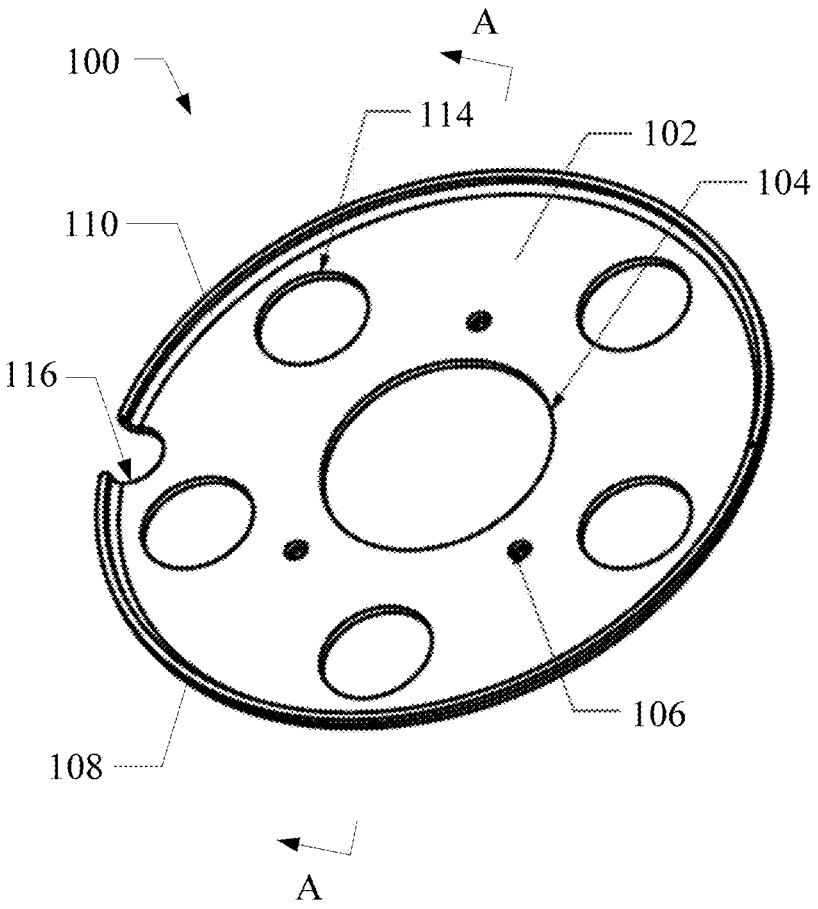
FIG. 1 shows a structural schematic diagram of a baffle plate according to Embodiment 1 of the present disclosure.

The description of the reference numerals shown in FIGS. 1 to 6 is provided as follows:

100 baffle plate, 102 plate body, 104 through hole, 106 welding hole, 108 flanging, 110 arc transition part, 112 exhaust through hole, 114 assembly yielding hole, 116 locating notch, 200 housing, 202 main housing, 204 top housing, 206 bottom housing, 300 motor, 302 stator, 304 rotor, 400 rotating shaft, 402 main shaft section, 404 eccentric shaft section, 510 main bearing, 512 bearing disk, 514 bearing neck, 520 auxiliary bearing, 600 cylinder, 700 annular rolling piston, 800 gas suction pipe and 900 silencer.

DETAILED DESCRIPTION OF EMBODIMENTS

In order that the above objects, features, and advantages of the present disclosure may be more clearly understood, the present disclosure will be described in further detail with reference to the accompanying drawings and preferred embodiments. It should be noted that the embodiments and features in the embodiments of the present disclosure may be combined with one another without conflict.

In the following description, many specific details are set forth in order to fully understand the present disclosure. However, the present disclosure can also be implemented in other ways different from those described herein. Therefore, the scope of the present disclosure is not limited by specific embodiments disclosed below.

A baffle plate 100 for compressors, a compressor and refrigeration apparatus according to some embodiments of the present disclosure will be described below with reference to FIGS. 1-10.

As shown in FIGS. 1-5, the embodiment of a first aspect of the present disclosure provides a baffle plate 100 for compressors. As shown in FIG. 6, when the compressor is in an operating condition, a rotor 304 rotates to drive a balance weight (not shown in the figure) at a lower part to rotate, so that the gas in the lower part of the compressor is in an unstable severe rotating state, to cause the problems of great fluctuation in an oil sump and high oil output. The baffle plate 100 provided by the present embodiment of the present disclosure comprises a plate body 102, a through hole 104 and a connection part (e.g., a welding hole 106). The through hole 104 is formed in the plate body 102, the plate body 102 extends from the through hole 104 in a direction deviating from the axis of the through hole 104, and the connection part is connected with the plate body 102 for connecting the plate body 102 to a non-rotating member.

A fixed baffle plate 100 is arranged in the compressor, for example, between a cylinder 600 and a motor 300 of the compressor. The baffle plate 100 is connected with the non-rotating member to prevent the baffle plate 100 from rotating, and the baffle plate 100 extends radially in the entire circumferential direction, thereby physically blocking the gas flow, and forming a space for stabilizing a refrigerant oil or lubricant oil on one side of the baffle plate 100 corresponding to the oil sump. The space can isolate the disturbance from spiral flow of a lower cavity to the oil sump caused by the rotation of the motor 300 when the compressor operates, thereby improving the stability of the oil sump, reducing the fluctuation of an oil level at the bottom of the compressor, further reducing the formation of oil droplets caused by the fluctuation, and preventing excessive refrigerant oil or lubricant oil from being brought to an upper part of the motor 300 by the gas flow due to severe fluctuation of the oil level. On the one hand, the baffle plate can be provided to reduce oil droplets entrained by the gas in the compressor, reduce the oil output of the compressor, and increase the COP of the compressor. On the other hand, the baffle plate can be provided to reduce the refrigerant oil or lubricant oil excessively accumulated in the upper part of the motor 300 in the compressor, and contribute to reducing pressure pulsation and noise. For the refrigeration apparatus, the baffle plate can be provided to reduce the resistance of refrigerant flowing in the compressor, improve the refrigerating capacity and heating capacity of the compressor, and increase the COP of the compressor.

In terms of connection, in some embodiments, the connection part comprises one or a combination of a welding part, a riveting part and an adhesion part.

In the present embodiment, the connection part is defined to comprise one or a combination of the welding part, the riveting part and the adhesion part, i.e., the baffle plate 100 can be fixedly connected with the non-rotating member in the compressor by welding, riveting and adhering, thereby reliably fixing the baffle plate 100. For example, as shown in FIG. 1, the welding part may be a welding hole 106 for facilitating the filling of solders, and the riveting part may be a rivet hole for allowing the mounting of a rivet. The adhesion part may be a structure convenient for setting adhesive, such as a groove, or, a part of the plate body 102 can serve as the adhesion part, so that a special structure is no longer provided.

The shape of the plate body 102 will be described below.

Overall, in some embodiments, the baffle plate 100 has a thickness of 0.5 mm to 4 mm.

In the present embodiment, the baffle plate 100 is defined to have the thickness of 0.5 mm to 4 mm, possibly 1 mm to 3 mm, which not only ensures that the baffle plate 100 is thick enough to effectively suppress the fluctuation of the oil level and also has enough rigidity to avoid damage from the impact of gas flow, thereby ensuring the reliability of products and prolonging the service life of the products, but also contributes to controlling the weight and material consumption of the baffle plate 100 and avoid unnecessary weight gain and material waste.

In addition, in some embodiments, the plate body 102 is one or a combination of a flat plate, an arc plate, a curved plate and a multi-section plate.

In the present embodiment, the plate body 102 of the baffle plate 100 may be one or a combination of the flat plate, the arc plate, the curved plate and the multi-section plate, all of which can physically block the gas flow and enrich the gas flow control manner. For example, as shown in FIGS. 1-3, the plate body 102 is the flat plate, and as shown in FIGS. 4 and 5, the plate body 102 is the multi-section plate.

Figure 4:
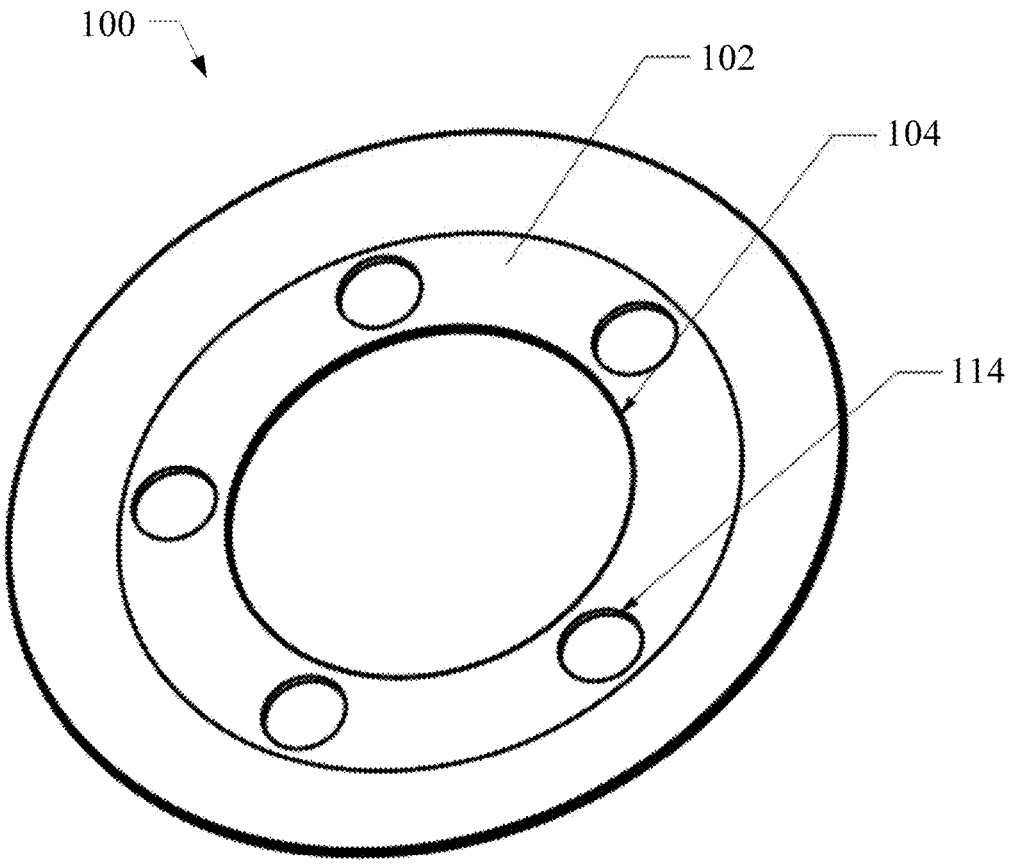
FIG. 4 shows a structural schematic diagram of a baffle plate according to Embodiment 3 of the present disclosure.
Figure 5:
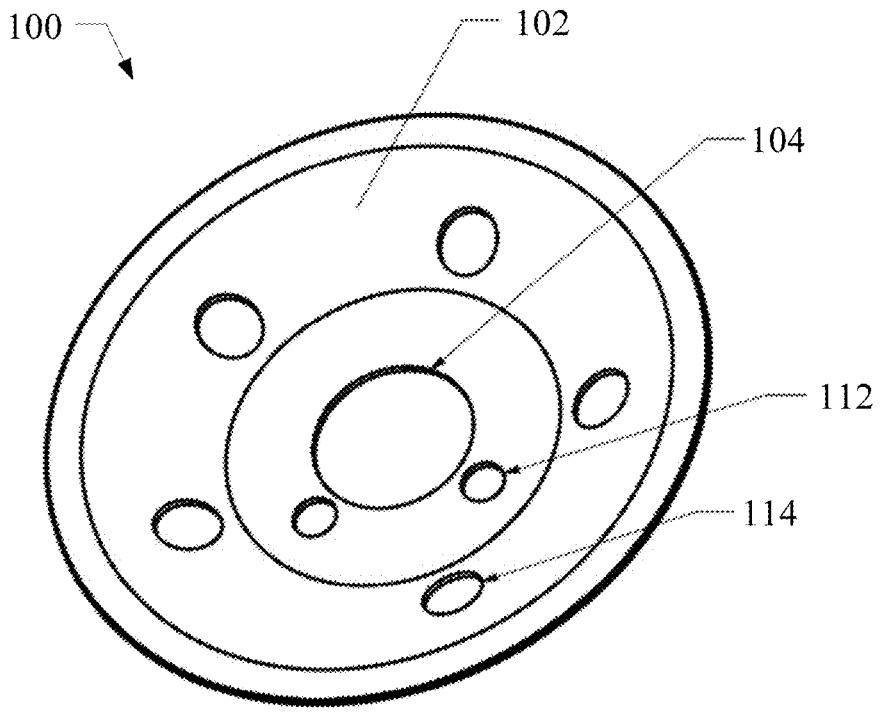
FIG. 5 shows a structural schematic diagram of a baffle plate according to Embodiment 4 of the present disclosure.
Figure 6:
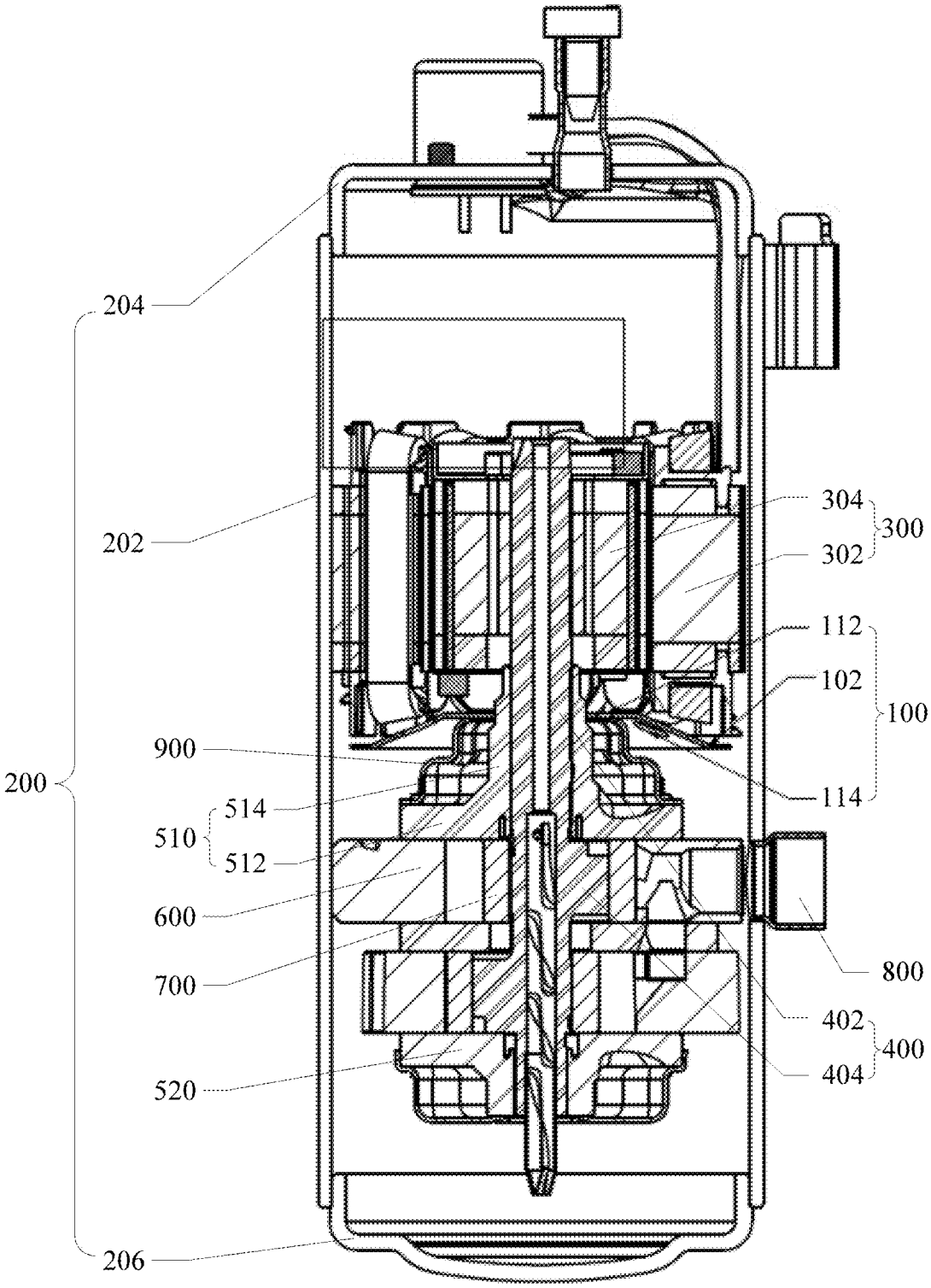
FIG. 6 shows a structural schematic diagram of a compressor according to embodiment of the present disclosure.

Further, in some embodiments, as shown in FIGS. 4 and 5, the plate body 102 extends in a direction parallel to the axis of the through hole 104.

In the present embodiment, the plate body 102 is defined to extend in the direction parallel to the axis of the through hole 104. For example, when the plate body 102 is one or a combination of the arc plate, the curved plate and the multi-section plate, the plate body 102 can extend not only radially but also axially. At this moment, the plate body 102 extends in one direction instead of two directions, such as, in a direction where the oil sump is located, so that the plate body 102 is umbrella-shaped to contribute to improving the effect of reducing the fluctuation of the oil level.

Figure 2:
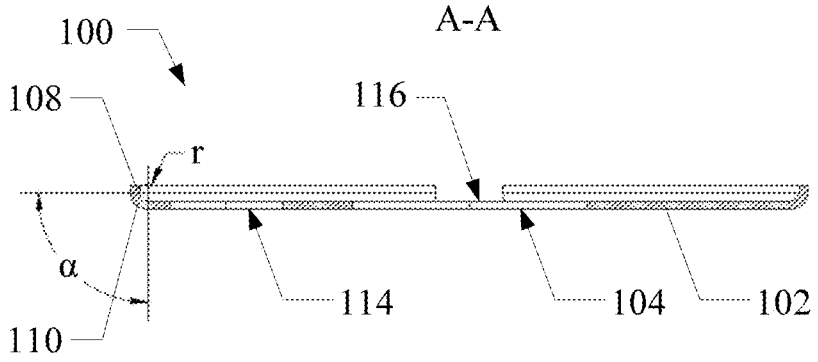
FIG. 2 shows a sectional view of Embodiment 1 of the present disclosure at a section A-A.
Figure 3:
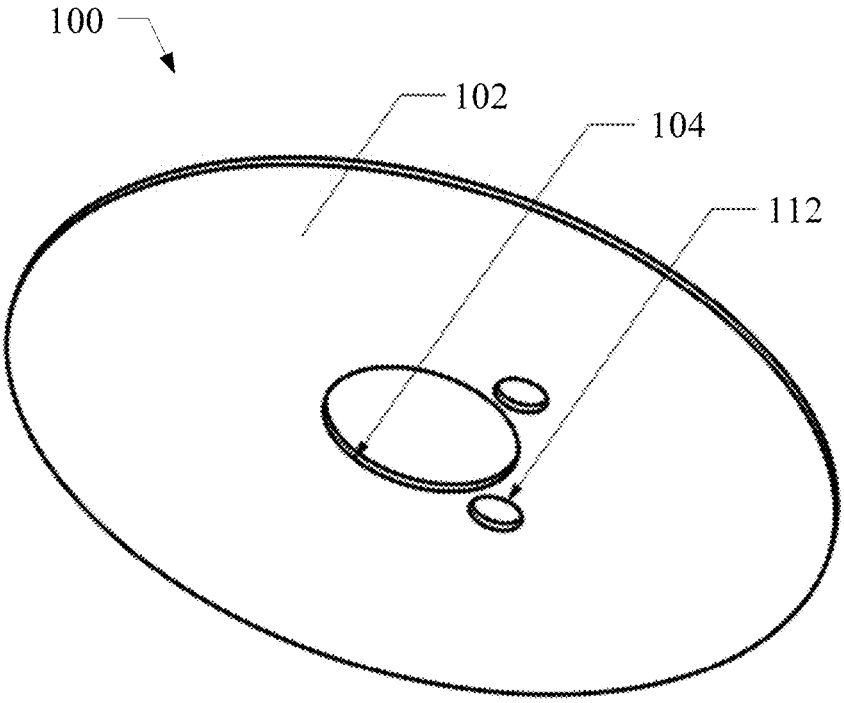
FIG. 3 shows a structural schematic diagram of a baffle plate according to Embodiment 2 of the present disclosure.

As to the detailed structure, for a first structure, in some embodiments, as shown in FIGS. 1 and 2, the baffle plate 100 also comprises a flanging 108, which is connected with an outer edge of the plate body 102.

In the present embodiment, the baffle plate 100 further comprises the flanging 108 arranged on the outer edge of the plate body 102. When the baffle plate 100 is mounted in the compressor, the flanging 108 can face one side where the motor 300 is located, to guide the gas flow in the lower cavity of the motor 300 upwardly and reduce the gas flow flowing downwards through the outer edge of the plate body 102, thereby keeping the oil sump stable.

Further, in some embodiments, as shown in FIGS. 1 and 2, the baffle plate 100 further comprises a transition part (such as, one or a combination of a bent transition part and a multi-section transition part. The bent transition part may be an arc transition part 110), and the transition part is connected between the plate body 102 and the flanging 108.

In the present embodiment, the baffle plate 100 further comprises the transition part connected between the plate body 102 and the flanging 108, so that the baffle plate 100 can be gradually bent to form the flanging 108, thereby not only avoiding forming a stress concentration point at a bending position during direct bending and contributing to improving the strength of the baffle plate 100, but also reducing flow resistance of the gas flow and improving the gas flow guiding effect.

For example, in some embodiments, as shown in FIG. 2, the transition part is the arc transition part 110, which has a radius of curvature r of 1 mm to 6 mm.

In the present embodiment, the transition part is defined as the arc transition part 110 with the radius of curvature r of 1 mm to 6 mm, further 1 mm to 5 mm, which ensures smooth transition and facilitates processing.

In some embodiments, as shown in FIG. 2, the arc transition part 110 has a central angle $\alpha$ of 35° to 145°.

In the present embodiment, the arc transition part 110 is defined to have the corresponding central angle $\alpha$ of 35° to 145°, further 45° to 135°, for example 90°, so that the plate body 102 and the flanging 108 are subjected to smooth transition, and the extension direction of the flanging 108 can be reasonably controlled by controlling the central angle $\alpha$ to achieve different gas flow guiding effects.

For a second structure, in some embodiments, as shown in FIGS. 3 and 5, the baffle plate 100 further comprises at least one exhaust through hole 112, which are formed in the plate body 102 and used for exhausting gas.

In the present embodiment, the baffle plate 100 further comprises at least one exhaust through hole 112 formed in the plate body 102 and used for exhausting the compressed gas, especially when the baffle plate 100 is arranged above a silencer 900 of the compressor as shown in FIG. 6. At this moment, the position of the exhaust through hole 112 may correspond to that of an exhaust port (not shown in the figure) of the silencer 900, i.e., a projection of the exhaust through hole 112 on an axial projection plane of the compressor corresponds to that of the exhaust port of the silencer 900 on the axial projection plane. For example, the exhaust through hole and the exhaust port may be equal in quantity and matched in dimension, thereby ensuring smooth exhaust of the silencer 900. It is understandable that the silencer 900 as shown in FIG. 6 is provided with a central hole for yielding to the main bearing 510, so that the silencer 900 can exhaust through the exhaust port or the central hole. For the latter, the silencer 900 is no longer provided with a special exhaust port, but the central hole serves as the exhaust port, and accordingly, the exhaust through hole 112 of the baffle plate 100 can be combined with the through hole 104, i.e., the through hole 104 and the exhaust through hole 112 are different names adopted when the same structure assumes different functions.

For a third structure, in some embodiments, as shown in FIGS. 1, 2, 4 and 5, the baffle plate 100 further comprises at least one assembly yielding hole 114, which are formed in the plate body 102.

In the present embodiment, the baffle plate 100 further comprises the assembly yielding hole 114 formed in the plate body 102. The number, dimensions and positions of the assembly yielding holes 114 can be set according to the structure assembling requirements of the compressor, to provide an enough assembly operation space when a certain structure needs to be arranged near the baffle plate 100, comprising but not limited to a welding operation space, a screw mounting space, a riveting operation space and an adhering operation space. For example, the assembly yielding holes 114 may correspond to rivet holes of the silencer 900, thereby contributing to ensuring the smooth assembly of various structures of the compressor.

For a fourth structure, in some embodiments, as shown in FIG. 1, the baffle plate 100 further comprises a locating part (such as a locating notch 116, a locating protrusion or a locating print line) arranged on the plate body 102.

In the present embodiment, when the baffle plate 100 is of a rotary structure, the locating part is arranged on the plate body 102, thereby conveniently and quickly implementing alignment when the baffle plate 100 is arranged, contributing to improving the assembly efficiency, reducing the mounting error rate, and ensuring the reliable operation of the compressor.

The above features can be combined as required. Several exemplary combinations for the cases that the baffle plate 100 is located between the silencer 900 and the motor 300 of the compressor will be introduced through four embodiments. For the convenience of description, the same reference numerals will be used for the structures playing the same role in different embodiments.

Embodiment 1

As shown in FIGS. 1 and 2, a baffle plate 100 comprises a plate body 102, a through hole 104, a connection part, a flanging 108, an arc transition part 110, at least one assembly yielding hole 114 and a locating notch 116. The plate body 102 is a flat plate extending from the through hole 104 in a direction deviating from the axis of the through hole 104. The through hole 104 is formed in the plate body 102. The connection part refers to welding holes 106 formed in the plate body 102 around the through hole 104 for welding the plate body 102 to a non-rotating member. At this moment, the non-rotating member may be a silencer 900 arranged on a main bearing 510 of a compressor. The plate body 102 is welded on an upper surface of the silencer 900, and the silencer 900 exhausts through a central hole. An aperture of the through hole 104 may be greater than or equal to that of the central hole, i.e., the central hole of the silencer also serves as the exhaust port. The through hole 104 of the baffle plate 100 also serves as an exhaust through hole 112, so that the silencer 900 can exhaust smoothly, and the assembly yielding holes 114 correspond to rivet holes of the silencer 900.

Embodiment 2

As shown in FIG. 3, a baffle plate 100 comprises a plate body 102, a through hole 104 and exhaust through holes 112. The plate body 102 is a flat plate extending from the through hole 104 in a direction deviating from the axis of the through hole 104. The through hole 104 is formed in the plate body 102, but at this moment, the silencer 900 does not exhaust through a central hole, but is additionally provided with a special exhaust port near the central hole, and accordingly, the aperture of the through hole 104 is set to be relatively small, and the exhaust through holes 112 are arranged at positions facing the exhaust port. In the present embodiment, no special connection part is provided, but the plate body 102 serves as the connection part.

Embodiment 3

As shown in FIG. 4, a baffle plate 100 comprises a plate body 102, a through hole 104 and at least one assembly yielding hole 114. The plate body 102 is an umbrella-shaped two-section plate extending from the through hole 104 in a direction deviating from the axis of the through hole 104. For example, the two-section plate comprises an inner plate and an outer plate, the inner plate extends in the direction deviating from the axis of the through hole 104 and a direction parallel to the axis of the through hole 104 at the same time, and is of a pneumatic tire shape, and the outer plate extends only in the direction deviating from the axis of the through hole 104, and is of a circular ring shape. The through hole 104, which is similar to that in Embodiment 1, also serves as an exhaust through hole 112, and is provided with the assembly yielding holes 114 to correspond to rivet holes of the silencer 900, and the assembly yielding holes 114 are formed in the inner plate. Similar to Embodiment 2, the plate body 102 serves as a connection part.

Embodiment 4

As shown in FIG. 5, a baffle plate 100 comprises a plate body 102, a through hole 104, exhaust through holes 112 and at least one assembly yielding hole 114. The plate body 102 is an umbrella-shaped three-section plate extending from the through hole 104 in a direction deviating from the axis of the through hole 104. For example, the three-section plate comprises an inner ring plate, a wheel platform plate and an outer ring plate, which are sequentially connected from inside to outside. Both the inner ring plate and the outer ring plate are flat plates extending only in the direction deviating from the axis of the through hole 104, and the wheel platform plate is similar to the inner plate in Embodiment 3. The through hole 104, which is similar to that in Embodiment 2, the exhaust through holes 112 are arranged at positions near the through hole 104 facing an exhaust port of a silencer 900, and is provided with the assembly yielding holes 114 correspond to rivet holes of the silencer 900. The exhaust through holes 112 are formed in the inner ring plate, and the assembly yielding holes 114 are formed in the wheel platform plate. Similar to Embodiment 2 and Embodiment 3, the plate body 102 serves as a connection part.

The embodiment of a second aspect of the present disclosure provides a compressor, which comprises the baffle plate 100 for compressors according to any one of the above embodiments, so that the compressor has all the beneficial technical effects of the baffle plate 100, which will not be described in detail here.

As shown in FIG. 6, the compressor may be a rotary compressor, such as, a double-cylinder rotary compressor, and the baffle plate 100 in Embodiment 4 is adopted in FIG. 6. In addition, the compressor further comprises a housing 200, a motor 300, a rotating shaft 400, a main bearing 510, an auxiliary bearing 520, a cylinder 600, an annular rolling piston 700, a gas suction pipe 800 and a silencer 900. The housing 200 comprises a main housing 202, a top housing 204, and a bottom housing 206. The top housing 204, and a bottom housing 206 are hermetically connected with a respective end of the main housing 202. The motor 300 comprises a stator 302 fixed on the housing 200 and a rotor 304 rotating in the stator 302. The rotating shaft 400 is combined with a center of the rotor 304, and comprises a main shaft section 402 and an eccentric shaft section 404. The main bearing 510 and the auxiliary bearing 520 are supported on an upper part and a lower part of the rotating shaft 400, respectively. The cylinder 600 is arranged between the main bearing 510 and the auxiliary bearing 520, the rotating shaft 400 penetrates the cylinder 600, and the eccentric shaft section 404 is located in the cylinder 600. The annular rolling piston 700 is also located in the cylinder 600 and is connected with the eccentric shaft section 404. A compression structure is composed of the rotating shaft 400, the main bearing 510, the auxiliary bearing 520, the cylinder 600 and the annular rolling piston 700. A compression cavity is formed between the cylinder 600 and the annular rolling piston 700, and one end of the cylinder 600 is connected with the gas suction pipe 800, to feed the gas to be compressed into the compression cavity. When the motor 300 drives the rotating shaft 400 to rotate, the eccentric shaft section 404 drives the annular rolling piston 700 to rotate to compress the gas in the compression cavity. The silencer 900 can cover one side of the main bearing 510 deviating from the cylinder 600 and facing the motor 300, or one side of the auxiliary bearing 520 deviating from the cylinder 600, thereby blocking the gas flow noise when the cylinder 600 exhausts. The silencer 900 is provided with a central hole for allowing the rotating shaft 400 and a neck part of the corresponding bearing to pass through. The silencer 900 can exhaust from the middle part through the central hole, or can be additionally provided with a special exhaust port for exhausting gas.

In terms of the mounting position of the baffle plate 100, in some embodiments, the baffle plate 100 is located between the cylinder 600 and the motor 300, and the rotating shaft 400 penetrates the through hole 104 of the baffle plate 100.

In the present embodiment, when the compressor is in an operating condition, the rotor 304 rotates to drive a balance weight at a lower part to rotate, so that the gas at the lower part of the compressor is in an unstable severe rotating state. The baffle plate 100 is arranged between the cylinder 600 and the motor 300, and the rotating shaft 400 is allowed to penetrate the through hole 104 of the baffle plate 100, so that a space for stabilizing the refrigerant oil or lubricant oil can be formed at one side of the baffle plate 100 deviating from the motor 300.

In terms of the radial dimension of the baffle plate 100, in some embodiments, a plane perpendicular to the axis of the rotating shaft 400 is taken as a reference plane, and a projection of the rotor 304 of the motor 300 on the reference plane is located within an outer contour of a projection of the baffle plate 100 on the reference plane.

In the present embodiment, the radial extension extent of the baffle plate 100 is defined by the reference plane and the rotor 304 of the motor 300. For example, when the baffle plate 100 extends, the extension direction needs to deviate from the axis of the through hole 104, but does not need to be strictly perpendicular to the axis of the through hole 104. The outer contour of the projection of the baffle plate 100 on the reference plane reflects a distance between the outer contour of the baffle plate 100 and the axis of the through hole 104, and also reflects the radial extension extent of the baffle plate 100. The projection of the rotor 304 is located within the outer contour of the projection of the baffle plate 100, to ensure that the baffle plate 100 completely covers the rotor 304 in the reference plane, thereby contributing to ensuring the isolation effect of the disturbance caused by the rotation of the rotor 304 and reducing the fluctuation of the oil level of the bottom refrigerant oil.

Further, in some embodiments, a distance between an outer edge of the baffle plate 100 and the housing 200 is less than or equal to 20% of an inner diameter of the housing 200.

In the present embodiment, the radial extension extent of the baffle plate 100 is defined from an angle of the distance between the outer edge of the baffle plate 100 and the housing 200. The distance is always less than or equal to 20% of the inner diameter of the housing 200, i.e., a maximum distance between the outer edge of the baffle plate 100 and an inner wall surface of the housing 200 is less than or equal to 20% of the inner diameter of the housing 200, or even 15% of the inner diameter of the housing 200, so that the flow resistance at the gap between the outer edge of the baffle plate 100 and the housing 200 is relatively large and the gas flow is relatively small, thereby keeping the oil sump at the lower part stable. The lower oil sump can thus be kept stable. The outer edge of the baffle plate 100 can be matched with the flanging 108 of the baffle plate 100 to further reduce the downward gas flow at the gap.

As for the non-rotating member connected with the baffle plate 100, in some embodiments, the non-rotating member is one or a combination of the housing 200, the main bearing 510 and the silencer 900.

In the present embodiment, the non-rotating member connected with the baffle plate 100 may be one or a combination of the housing 200, the main bearing 510 and the silencer 900, in which the silencer 900 is connected with the main bearing 510, i.e., the baffle plate 100 may be fixedly connected with any one, any two or all three of the housing 200, the main bearing 510 and the silencer 900, thereby reliably locating and fixing the baffle plate 100.

For example, when the non-rotating member is the housing 200, the baffle plate 100 extends radially to contact the housing 200 and is mounted on the housing 200.

When the non-rotating member is the main bearing 510, the main bearing 510 comprises a bearing disk 512 and a bearing neck 514. The bearing disk 512 is in contact the cylinder 600. The bearing neck 514 is connected to one side of the bearing disk 512 deviating from the cylinder 600 and extends in a length direction of the rotating shaft 400. In terms of connection relationship, the baffle plate 100 may be sleeved on the main bearing 510 by means of the through hole 104, and for example, may be sleeved on the bearing disk 512 or on the bearing neck 514. In terms of the mounting position, the baffle plate 100 may be further located between the bearing disk 512 and the motor 300, thereby reserving enough space between the baffle plate 100 and the cylinder 600 to form a stable space, which contributes to isolating the disturbance and reducing the fluctuation of the oil level of the bottom refrigerant oil. It is understandable that when the baffle plate 100 is located between the bearing disk 512 and the motor 300, the baffle plate 100 is connected with the bearing neck 514 of the main bearing 510, for example, as shown in FIG. 6, and the baffle plate 100 further rises to be located between the silencer 900 and the motor 300 and connected with the bearing neck 514. In addition, when the baffle plate 100 extends to contact the housing 200, the baffle plate 100 may be only connected with the main bearing 510, or may be simultaneously connected with the main bearing 510 and the housing 200, i.e., the non-rotating member refers to the housing 200 and the main bearing 510.

When the non-rotating member is the silencer 900, in terms of the connection relationship, the baffle plate 100 may be arranged at the top of the silencer 900 and connected with an upper surface of the silencer 900. The baffle plate 100 may also be sleeved on the silencer 900 and connected with the outer surface of the silencer 900 at this moment. The baffle plate 100 may also be arranged at the bottom of the silencer 900, for example, the baffle plate 100 is sandwiched between the silencer 900 and the main bearing 510, or the silencer 900 is sandwiched between the baffle plate 100 and the main bearing 510. For the former, the baffle plate 100 is simultaneously connected with the silencer 900 and the main bearing 510, i.e., the non-rotating member refers to the silencer 900 and the main bearing 510. For the stepped silencer 900, the baffle plate 100 may also be connected with a stepped surface of the silencer 900, and the stepped surface of the silencer 900 is approximately parallel to the upper surface. In terms of the mounting position, the baffle plate 100 may be further located between the silencer 900 and the motor 300, thereby continuing to increase the distance between the baffle plate 100 and the cylinder 600 to reduce the fluctuation of the oil level of the bottom refrigerant oil. It is understandable that the baffle plate 100 is connected with the upper surface of the silencer 900 at this moment. Similarly, when the baffle plate 100 extends to contact the housing 200, the baffle plate 100 may also be connected with the housing 200, i.e., the non-rotating member further comprises the housing 200.

As for the exhausting of gas, in some embodiments, the exhaust through hole 112 of the baffle plate 100 is located on one side of the exhaust port of the silencer 900 facing the motor 300, and faces the exhaust port.

In the present embodiment, the positional relationship between the exhaust through hole 112 of the baffle plate 100 and the exhaust port of the silencer 900 is defined. When the exhaust through hole 112 is located on the side of the exhaust port of the silencer 900 facing the motor 300, i.e., above the exhaust port, the exhaust through hole 112 is allowed to face the exhaust port, i.e., the projection of the exhaust through hole 112 on the axial projection plane of the compressor corresponds to that of the exhaust port of the silencer 900 on the axial projection plane, and the exhaust through hole 112 and the exhaust port may be equal in quantity and matched in dimension, thereby ensuring smooth exhaust of the silencer 900.

In other embodiments, the baffle plate 100 is located between the silencer 900 and the motor 300, and the aperture of the through hole 104 of the baffle plate 100 is greater than or equal to that of the central hole of the silencer 900.

In the present embodiment, in terms of the mounting position, the baffle plate 100 is arranged between the silencer 900 and the motor 300, at this moment, if the aperture of the through hole 104 is greater than or equal to that of the central hole of the silencer 900, the silencer 900 can exhaust smoothly when the silencer 900 exhausts through the central hole, thereby ensuring the reliable operation of the compressor. The present embodiment can be regarded as a special case of the previous embodiment, i.e., the exhaust through hole 112 is combined with the through hole 104. It is understandable that the central hole here refers to the central hole of the outer silencer for an inner and outer double-layer silencer structure.

As for assembly, in some embodiments, the silencer 900 is provided with an assembly part, the silencer 900 is connected with the main bearing 510 through the assembly part, and the assembly yielding holes 114 of the baffle plate 100 face the assembly part.

In the present embodiment, the silencer 900 is also provided with the assembly part to realize connection with the main bearing 510. The assembly part may be a rivet hole for allowing the silencer 900 to be riveted with the main bearing 510. The assembly yielding holes 114 of the baffle plate 100 face the assembly part, so that the number, dimensions and positions of the assembly yielding holes 114 correspond to those of the assembly part, which can ensure that the silencer 900 is smoothly assembled, and is suitable for assembling and connecting the silencer 900 with the baffle plate 100 first and subsequently assembling the silencer 900 on the bearing 510.

Two sets of test data for the compressor provided by the embodiments of the present disclosure will be introduced below.

Test 1:

The baffle plate 100 in Embodiment 1, i.e., the baffle plate 100 shown in FIGS. 1 and 2, is adopted in the compressor, arranged at the top of the silencer 900, and connected with the upper surface of the silencer 900, i.e., arranged at a position in FIG. 6. For the three compressor frequencies of 60 Hz, 90 Hz and 120 Hz, the oil output and the coefficient of performance (called COP for short) before and after arranging the baffle plate 100 are tested respectively, as shown in Table 1 below.

TABLE 1

Test 1 Oil Output and COP Before and After Arranging the Baffle Plate at Different Frequencies.

| | Sample with the baffle plate | | Sample without the baffle plate | |
|---|---|---|---|---|
| | Oil output/% | COP/% | Oil output/% | COP/% |
| 60 Hz | 0.31 | 396.3 | 0.51 | 390 |
| 90 Hz | 0.38 | 243.2 | 0.5 | 240 |
| 120 Hz | 0.47 | 216.8 | 0.53 | 209.7 |

Figure 7:
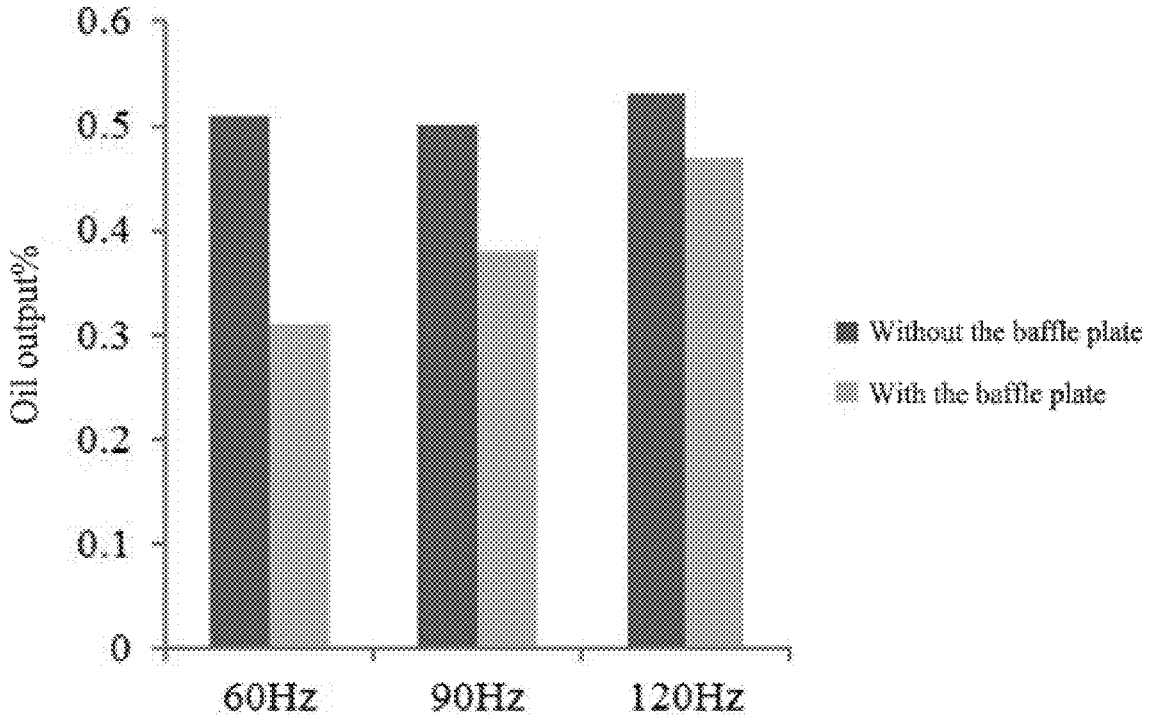
FIG. 7 shows a comparison chart of oil output of a compressor with and without a baffle plate according to an embodiment of the present disclosure.
Figure 8:
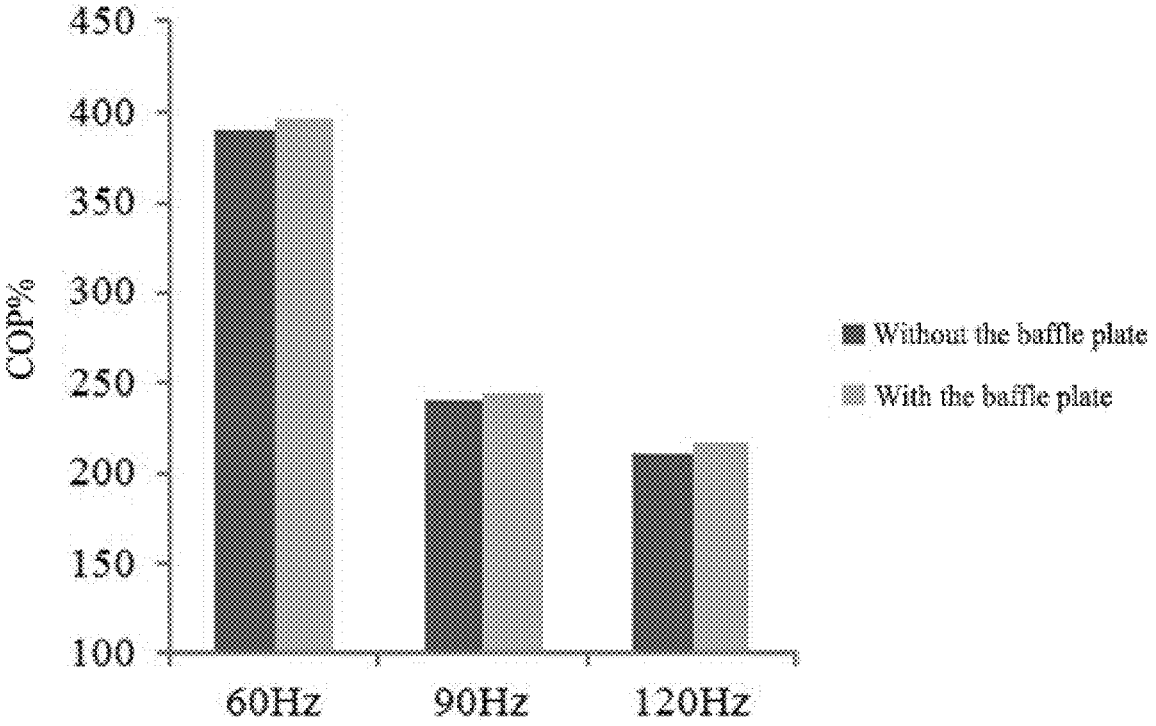
FIG. 8 shows a comparison chart of COP of a compressor with and without a baffle plate according to an embodiment of the present disclosure.

FIG. 7 shows a comparison chart of oil output in the compressor with and without the baffle plate 100. Table 1 and FIG. 7 show that the baffle plate 100 is arranged at the three frequencies to apparently reduce the oil output of the compressor. The lower the frequency is, the greater the reduction amplitude is, and the reduction amplitudes are respectively up to 39%, 24% and 11%. FIG. 8 shows a comparison chart of COP of the compressor with and without the baffle plate 100. Table 1 and FIG. 8 show that the baffle plate 100 is arranged at the three frequencies to increase the COP of the compressor by 1.6%, 1.3% and 3.4%, respectively. Apparently, the oil output is reduced, and the COP is increased after the baffle plate 100 in Embodiment 1 is applied to the compressor, thereby improving the refrigerating and heating effects of the refrigeration apparatus provided with the baffle plate 100 or the compressor.

Test 2:

The baffle plate 100 in Embodiment 3, i.e., the baffle plate 100 shown in FIG. 4, is adopted in the compressor, arranged at the top of the silencer 900, and connected with the upper surface of the silencer 900, i.e., arranged at a position in FIG. 6. For the two compressor frequencies of 60 Hz and 90 Hz, the oil output and the COP before and after arranging the baffle plate 100 are tested respectively, as shown in Table 2 below.

TABLE 2

Test 2 Oil Output and COP Before and After Arranging the Baffle Plate at Different Frequencies

| | Sample with the baffle plate | | Sample without the baffle plate | |
|---|---|---|---|---|
| | Oil output/% | COP/% | Oil output/% | COP/% |
| 60 Hz | 2 | 388 | 7.29 | 385 |
| 90 Hz | 2.71 | 244 | 7.63 | 239 |

Figure 9:
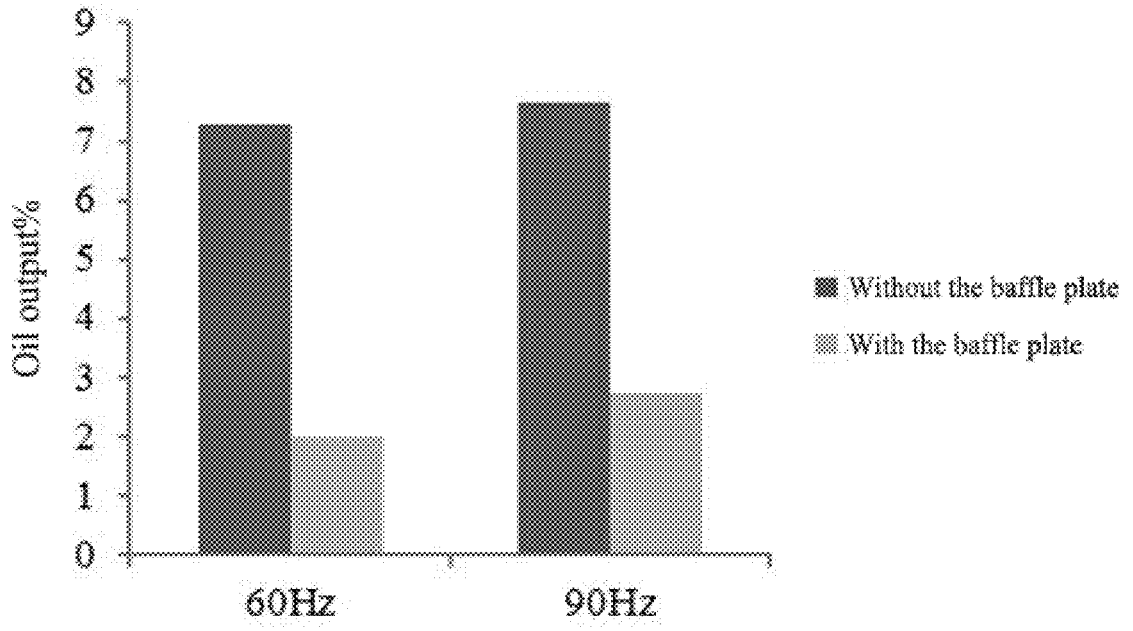
FIG. 9 shows a comparison chart of oil output of a compressor with and without a baffle plate according to another embodiment of the present disclosure.
Figure 10:
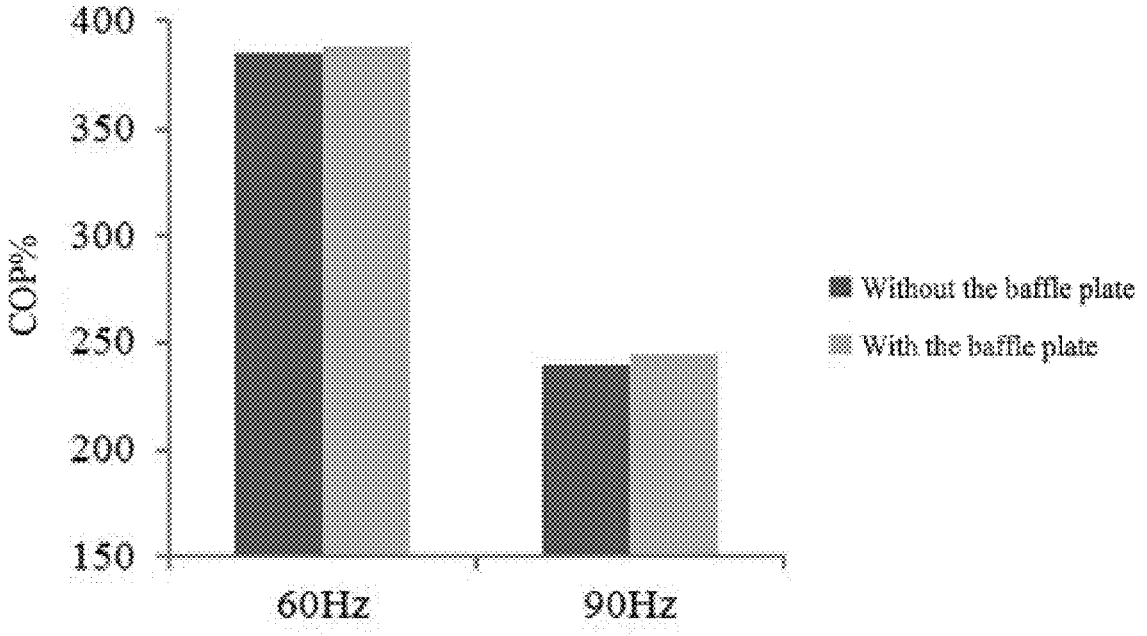
FIG. 10 shows a comparison chart of COP of a compressor with and without a baffle plate according to another embodiment of the present disclosure.

FIG. 9 shows a comparison chart of oil output in the compressor with and without the baffle plate 100. Table 2 and FIG. 9 show that the baffle plate 100 is arranged at the two frequencies to greatly reduce the oil output of the compressor by 73% and 64%, respectively. FIG. 10 shows a comparison chart of COP of the compressor with and without the baffle plate 100. Table 2 and FIG. 10 show that the baffle plate 100 is arranged at the two frequencies to increase the COP of the compressor by 0.8% and 2.1%, respectively. Apparently, the oil output is reduced, and the COP is increased after the baffle plate 100 in Embodiment 3 is applied to the compressor, thereby improving the refrigerating and heating effects of the refrigeration apparatus provided with the baffle plate 100 or the compressor.

An embodiment of a third aspect of the present disclosure provides refrigeration apparatus, which comprises the baffle plate 100 for compressors according to any one of the above embodiments, or the compressor according to any one of the above embodiments, thereby having all the beneficial technical effects of the baffle plate 100 or the compressor, which will not repeated here. The refrigeration apparatus may be a refrigerator or an air conditioner, such as a central air conditioner.

Further, the refrigeration apparatus also comprises a heat exchanger and a throttle valve, which are directly or indirectly connected with the compressor to form a refrigerating circuit or a heating circuit.

In the present disclosure, the term "a plurality of" refers to two or more, unless explicitly defined otherwise. The terms such as "installation", "connected", "connecting", "fixation" and the like shall be understood in broad sense, and for example, "connecting" may be a fixed connection, a detachable connection, or an integral connection, "connected" may be directly connected, or indirectly connected through an intermediary. The specific meaning of the above terms in the present disclosure will be understood by those of ordinary skills in the art, as the case may be.

In the illustration of the description, the illustration of the terms of "one embodiment", "some embodiments", "specific embodiment", etc. means that the specific features, structures, materials, or characteristics described in conjunction with the embodiments or examples are included in at least one embodiment or example of the present disclosure. In this description, schematic representations of the above terms do not necessarily refer to the same embodiment or example. Moreover, the specific features, structures, materials, or characteristics described may be combined in any suitable manner in any one or more embodiments or examples.

The foregoing is only a preferred embodiment of the present disclosure and is not intended to limit the present disclosure. For those skilled in the art, the present disclosure can have various modifications and changes. Any modification, equivalent replacement, improvement, etc. that made within the spirit and principle of the present disclosure are intended to be included within the scope of the present disclosure.

What is claimed is:

1. A compressor comprising:

a cylinder;

a rotating shaft penetrating through the cylinder;

a motor, being connected with a part of a shaft section of the rotating shaft extending out of the cylinder and driving the rotating shaft to rotate;

a silencer;

an oil sump;

a baffle plate comprising:

a plate body defining a through hole, wherein the plate body extends from the through hole in a direction deviating from an axis of the through hole;

a connection part, being connected with the plate body and used for connecting the plate body to a non-rotating member;

a flanging; and an arc transition part that connects an outer edge of the plate body and the flanging, and has a radius of curvature of 1 mm to 6 mm and a central angle of 35° to 145°; and a housing, in which the cylinder, the rotating shaft, the motor, the oil sump and the baffle plate are located, wherein the cylinder and the oil sump are located on one side of the baffle plate and the motor is located on another side of the baffle plate, wherein the rotating shaft penetrates the through hole of the baffle plate, wherein a distance of a gap between the outer edge of the baffle plate and an inner wall surface of the housing is less than or equal to 20% of an inner diameter of the housing, wherein the baffle plate is formed of a separate structure as the silencer and attached thereto via the connection part, wherein the baffle plate extends in the direction deviating from the axis of the through hole and the flanging extends from the plate body in the direction of the another side of the baffle plate to reduce gas flow from the motor towards the oil sump and past the outer edge of the plate body, wherein the baffle plate further comprises at least one exhaust through hole formed in the plate body and used for exhausting gas, wherein the exhaust through hole of the baffle plate is located at one side of an exhaust port of the silencer facing the motor, and faces the exhaust port, and wherein the plate body extends in a direction of the oil sump in an umbrella-shape.

2. The compressor according to claim 1, further comprising at least one assembly yielding hole, being formed in the plate body, configured to gain access to one or more parts of the compressor above or below the baffle plate.

3. The compressor according to claim 1, wherein the connection part comprises at least one of a welding part, a riveting part and an adhesion part.

4. The compressor according to claim 1, wherein the plate body comprises at least one of a flat plate, an arc plate, a curved plate and a multi-section plate.

5. The compressor according to claim 4, wherein the plate body extends in a direction parallel to the axis of the through hole.

6. The compressor according to claim 1, wherein the baffle plate has a thickness of 0.5 mm to 4 mm.

7. The compressor according to claim 1, wherein, when taking a plane perpendicular to the axis of the rotating shaft as a reference plane, a projection of a rotor of the motor on the reference plane is located within an outer contour of a projection of the baffle plate on the reference plane.

8. The compressor according to claim 1, further comprising:

a main bearing, being sleeved on the rotating shaft and located on one side of the cylinder facing the motor, wherein the silencer is arranged on one side of the main bearing deviating from the cylinder, wherein the rotating shaft penetrates the silencer, and wherein the non-rotating member is one or a combination of the housing, the main bearing and the silencer.

9. The compressor according to claim 8, wherein the baffle plate further comprises at least one assembly yielding hole formed in the plate body, and wherein the silencer is provided with an assembly part, wherein the silencer is connected with the main bearing through the assembly part, and the at least one assembly yielding hole of the baffle plate faces the assembly part.

10. The compressor according to claim 8, wherein the baffle plate is located between the silencer and the motor, and wherein an aperture of the through hole of the baffle plate is greater than or equal to an aperture of a central hole of the silencer.

11. A refrigeration apparatus comprising the compressor according to claim 1.

* * * * *